US007536941B2

(12) United States Patent
Chou et al.

(10) Patent No.: US 7,536,941 B2
(45) Date of Patent: May 26, 2009

(54) AUTOMATIC CUTTING MACHINE HAVING RECEIVING DEVICE FOR LENS

(75) Inventors: Lee Jung Chou, Taichung (TW); Liu Zhong Liang, Dong-Guan (CN)

(73) Assignee: Asia Optical Co., Inc., Taichung (TW)

( * ) Notice: Subject to any disclaimer, the term of this patent is extended or adjusted under 35 U.S.C. 154(b) by 121 days.

(21) Appl. No.: 11/070,221

(22) Filed: Mar. 3, 2005

(65) Prior Publication Data

US 2006/0006206 A1 Jan. 12, 2006

(30) Foreign Application Priority Data

Jul. 7, 2004 (TW) ..... 93120326 A

(51) Int. Cl.
*B26D 1/06* (2006.01)
*B26F 3/02* (2006.01)

(52) U.S. Cl. ..... 83/563; 83/213; 83/255; 83/280; 83/425; 83/465; 83/517; 83/556; 83/694; 225/23; 241/301

(58) Field of Classification Search ..... 83/13, 83/704, 36, 906, 864, 401, 73, 279, 280, 83/452, 75, 76.8, 213, 212.1, 216, 217, 255, 83/465, 651, 517, 522.22, 563, 556, 694; 225/23; 451/182, 28, 23, 128, 188, 445, 451/450, 53, 178, 449; 241/1, 301, 3, 101.4, 241/101.2; 144/3.1, 1.1, 2.1
See application file for complete search history.

(56) References Cited

U.S. PATENT DOCUMENTS

| | | | | |
|---|---|---|---|---|
| 3,880,048 | A * | 4/1975 | Zimmerman | 409/97 |
| 5,158,124 | A * | 10/1992 | Lewis, Jr. | 144/2.1 |
| 5,842,461 | A * | 12/1998 | Azuma | 125/13.01 |
| 6,102,023 | A * | 8/2000 | Ishiwata et al. | 125/13.01 |
| 6,145,424 | A * | 11/2000 | Matsuda et al. | 83/227 |
| 6,171,176 | B1 * | 1/2001 | Kajiyama et al. | 451/28 |
| 6,949,015 | B2 * | 9/2005 | Kubota | 451/178 |
| 2002/0178884 | A1 * | 12/2002 | Chuang et al. | 83/24 |
| 2004/0083868 | A1 * | 5/2004 | Ohmiya | 83/168 |
| 2005/0150344 | A1 * | 7/2005 | Nien et al. | 83/651 |
| 2005/0204881 | A1 * | 9/2005 | Chen | 83/13 |

* cited by examiner

*Primary Examiner*—Ghassem Alie

(57) ABSTRACT

An automatic lens cutting machine (1) includes a body portion, a carrying device (10), a cutting device (20), a take out device (30), a power device and an electrical control portion. The take out device is mounted adjacent to the carrying device, and comprises a shelf (31) mounted on a base (40) of the body portion and a lens receiving device (34) disposed above the shelf. The lens receiving device has a plurality of rows of tubular rings. Each row has a plurality of rings. The rings receive unseparated lenses (90) on a semi-finished lens assembly (9) therein when the automatic lens cutting machine is in operation, and retain the separated lenses therein after the semi-finished lens assembly is subject to a cutting operation.

8 Claims, 15 Drawing Sheets

AUTOMATIC CUTTING MACHINE HAVING RECEIVING DEVICE FOR LENS

BACKGROUND OF THE INVENTION

1. Field of the Invention

The present invention relates to an automatic cutting machine, and particularly relates to an automatic cutting machine having a receiving device for lens.

2. Description of Prior Art

Materials employed in the generating of lenses are basically those of glass (inorganic) or plastic (organic) compounds. As an inorganic material, glass has excellent transparency. However, to obtain an optical lens, the glass substrate must be subject to a plurality of processes, such as coarse grind, fine grind and polish processes. This results in increased cost. Accordingly, a plastic material, such as polycarbonate, is generally used for optical lenses. Polycarbonate lenses are the most-used alternative material for modem consuming product lenses. The polycarbonate lens is thinner, lighter, and provides greater impact resistance, high refractive index, complete UV protection, heat resistance and easy processability.

Plastic becomes soft when heated, and thus can be molded into any desired shape by applying heat and pressure to it. A schematic view of a semi-finished plastic lens assembly 9 with scraps is shown in FIG. 1. The lens assembly 9 is molded from a four-cavity mold and thus has four lenses 90 formed thereon. The lens assembly 9 comprises a vertical runner scrap 91 and a horizontal runner scrap 92 connecting with the lenses 90 via four connecting portions 93. The four lenses 90 are separated from the runner scraps 91, 92 by cutting the horizontal runner scrap 92 at the connecting portions 93.

Conventionally, the lenses 90 are separated from the runner scraps 91, 92 by manual cutting. This reduces production efficiency and provides unstable lens quality due to the operator's skill level. Additionally, with the rapid development of the technology, lenses used in consuming products, such as mobile phones, are becoming increasingly smaller. This also makes manual cutting more and more difficult and unpractical.

The emergency of an automatic cutting machine addresses the above-mentioned problems of manual cutting. A conventional automatic cutting machine generally employs a mechanically linked robotic arm to pick up the lenses. That is, the gripper of the robotic arm grips the runner to place the lens on a tray. The runner scraps are then cut. The separated lens is sucked up by a cupula of the robotic arm and finally placed into a lens receiver for stockage. However, as the cupula of the robotic arm of the conventional automatic cutting machine keeps intimate contact with the lens during the sucking process, the lens may be damaged. In addition, the multi-axis mechanism, positioning portion and control device applied by the conventional automatic cutting machine are rather complex and bulky, which also increases cost and occupies a large space.

Therefore, an improved automatic cutting machine is desired to overcome the above-mentioned disadvantages present in prior art.

SUMMARY OF THE INVENTION

Accordingly, one object of the present invention is to provide an automatic cutting machine that facilitates operation, occupies a small space, realizes integration of cutting and packaging, and ensures reliable and efficient output of high-quality products.

Another object of the present invention is to provide a lens cutting device that increases cutting efficiency and lens yield.

A further object of the present invention is to provide an automatic cutting machine having a take out device for lens. The take out device ensures rapid take out of lens to increase production efficiency, and also prevents the lens from contamination or damage.

Yet another object of the present invention is to provide a method for cutting lens, whereby integration of lens cutting and packaging can be realized, and production efficiency and lens yield can be increased.

According to one object of the present invention, there is provided an automatic cutting machine comprising a body portion, a carrying device, a cutting device, a take out device, a power device and an electrical control portion. The body portion has a base and a power supply unit. The carrying device comprises a shelf mounted on the base of the body portion, and a receptacle above the shelf for carrying a semi-finished lens assembly. Lenses on the semi-finished lens assembly are outwardly exposed to the outside of the receptacle for facilitating cutting. The cutting device, which is adjacent to the carrying device, comprises a shelf mounted on the base of the body portion and a scissor seat movably disposed on the shelf. The scissor seat has cutting blades for cutting the semi-finished lens assembly. The take out device is also located adjacent to the carrying device, and comprises a shelf mounted on the base of the body portion and a receiving device for receiving the projected lenses of the semi-finished lens assembly. After the cutting device separates the lenses from the semi-finished lens assembly, the lenses are retained in the receiving device. The power device is adapted to provide power to the cutting device and the take out device for moving. The electrical control portion comprises programmable logic controllers and relays.

According to another object of the present invention, there is provided a lens cutting device applied in the above automatic cutting machine for cutting a semi-finished lens assembly to obtain separated lenses. The semi-finished lens assembly includes runner scraps, four lenses, and four connecting portions between the runner scraps and the lenses. The cutting device includes two subassemblies each comprising a shelf and a scissor seat movably disposed on the shelf. The scissor seat has opposed first and second pairs of scissors. Each pair of scissors has two cutting blades. Thus, four groups of vertically aligned opposing cutting blades are provided on the cutting device each corresponding to a connecting portion of the semi-finished lens assembly. When each group of opposing cutting blades is driven to close, the aligned corresponding connecting portion of the semi-finished lens assembly is cut off. Thus, four separate lenses are obtained at one time, thereby increasing cutting efficiency.

According to a further object of the present invention, there is provided a lens take out device applied in the above automatic cutting machine for containing lenses. The take out device is located aside a carrying device of the automatic cutting machine, and comprises a shelf mounted on the base of the automatic cutting machine and a lens receiving device. The lens receiving device has multirow tubular rings, each row having a plurality of rings aligned for receiving lenses therein. When the automatic cutting machine starts up to work, the lens of the semi-finished lens assembly is received in the ring for cutting. When the cutting operation is performed, the separated lens is retained in the receiving device. Therefore, integration of cutting and packaging is realized and take out efficiency is thus increased.

According to yet another object of the present invention, there is provided a method for cutting lens performed by the above automatic cutting machine. The method comprises the following steps of: a) turning on the power, starting up the automatic cutting machine, and resetting the carrying device, the cutting device and the take out device of the automatic cutting machine to their original positions; b) positioning a semi-finished lens assembly in a receptacle of the carrying device via a robotic arm with lenses of the semi-finished lens assembly projecting outwardly from the receptacle; c) driving the take out device by the power device to move toward the receptacle of the carrying device to a predetermined position, whereby the projected lenses of the semi-finished lens assembly are received in corresponding rings of the receiving device of the take out device; d) driving the cutting device by the power device to move toward the receptacle of the carrying device to a predetermined position, and closing the vertically aligned opposing cutting blades of the scissors of the cutting device to cut the connecting portions of the semi-finished lens assembly between the lenses and the runner scraps, whereby the lenses are separated and retained in corresponding rings of the take out device; e) opening the vertically aligned opposing cutting blades of the scissors of the cutting device and returning the scissors to their original positions; f) returning the take out device to its original position; g) taking away the remaining runner scraps of the semi-finished lens assembly by the robotic arm; h) counting the number of lenses received in the tubular rings of the receiving device of the take out device by a counter; if the result being less than the maximal number of lenses being receivable in one row of tubular rings, repeating the above steps b) to g); if the result being equal to or greater than the maximal number of lenses being receivable in one row of tubular rings, raising the positioning portions of the receiving device to a higher level so that a lower row of tubular rings is in position for receiving lenses, and then repeating the above steps b) to g) until the counted total number of lenses received in the receiving device is equal to the maximal number of lenses being receivable in all rows of tubular rings; and i) replacing the lens receiving devices and resetting the carrying device, the cutting device and the take out device to repeat steps b) to h).

The automatic cutting machine of the present invention employs a take out device having a lens receiving device. This enables integration of lens cutting and packaging, and ensures rapid take out of lenses to obtain high-quality lenses. In addition, since the cutting device of the present automatic cutting machine cuts four lenses at one time, production efficiency is significantly increased.

BRIEF DESCRIPTION OF THE DRAWINGS

The present invention may best be understood through the following description with reference to the accompanying drawings, in which.

DETAILED DESCRIPTION OF THE INVENTION

Figure 2:
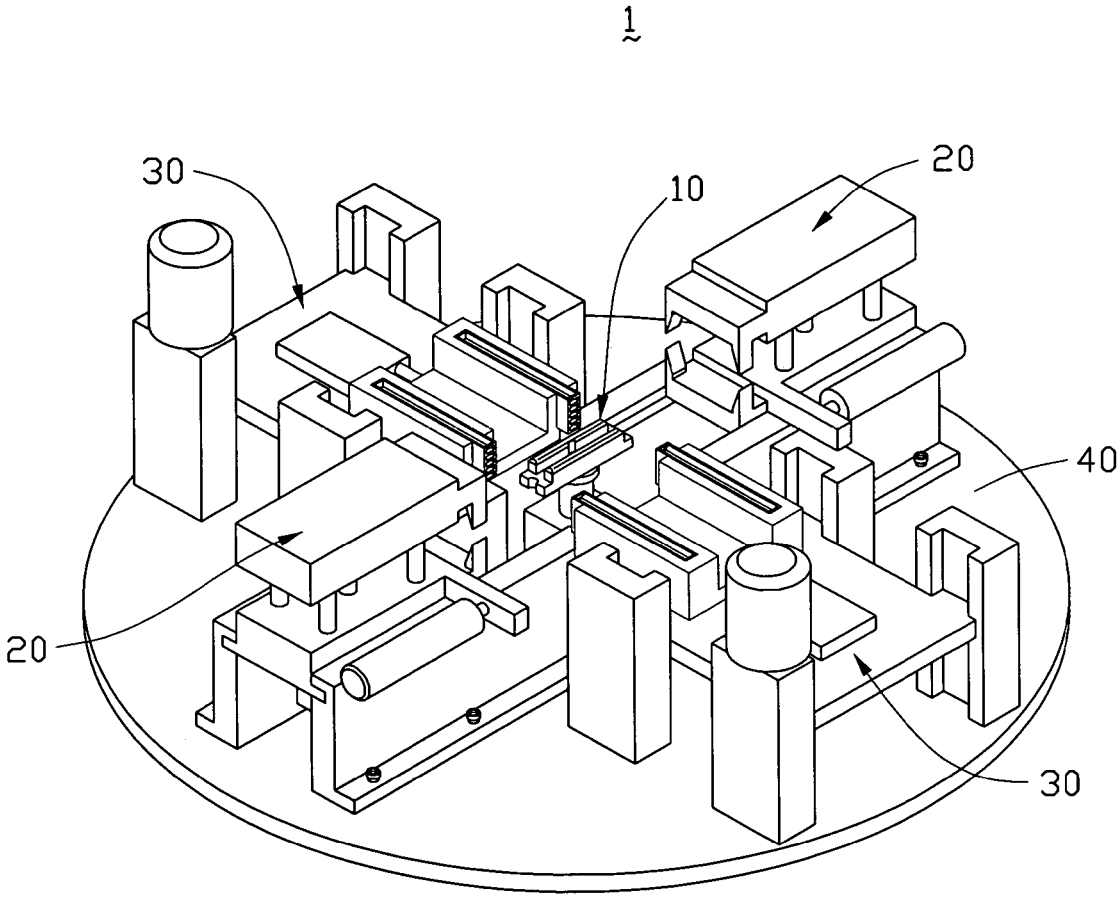
FIG. 2 is a schematic view of the configuration of an automatic cutting machine in accordance with the present invention.

Referring to FIG. 2, an automatic cutting device 1 in accordance with the present invention comprises a carrying device 10, a cutting device 20, a take out device 30, a body portion where these devices are mounted, and an electrical control portion for controlling the operation of these devices. The body portion includes a base 40, a power supply unit and other accessory equipments. The electrical control portion comprises programmable logic controllers, relays and other accessory circuits. Since the inventive features of the present invention lie on the integrated configuration of the carrying device 10, the cutting device 20 and the take out device 30, and the corresponding cutting method thereof, a detailed description of the related conventional devices, such as accessory equipments and circuits, will be omitted herein.

Figure 1:
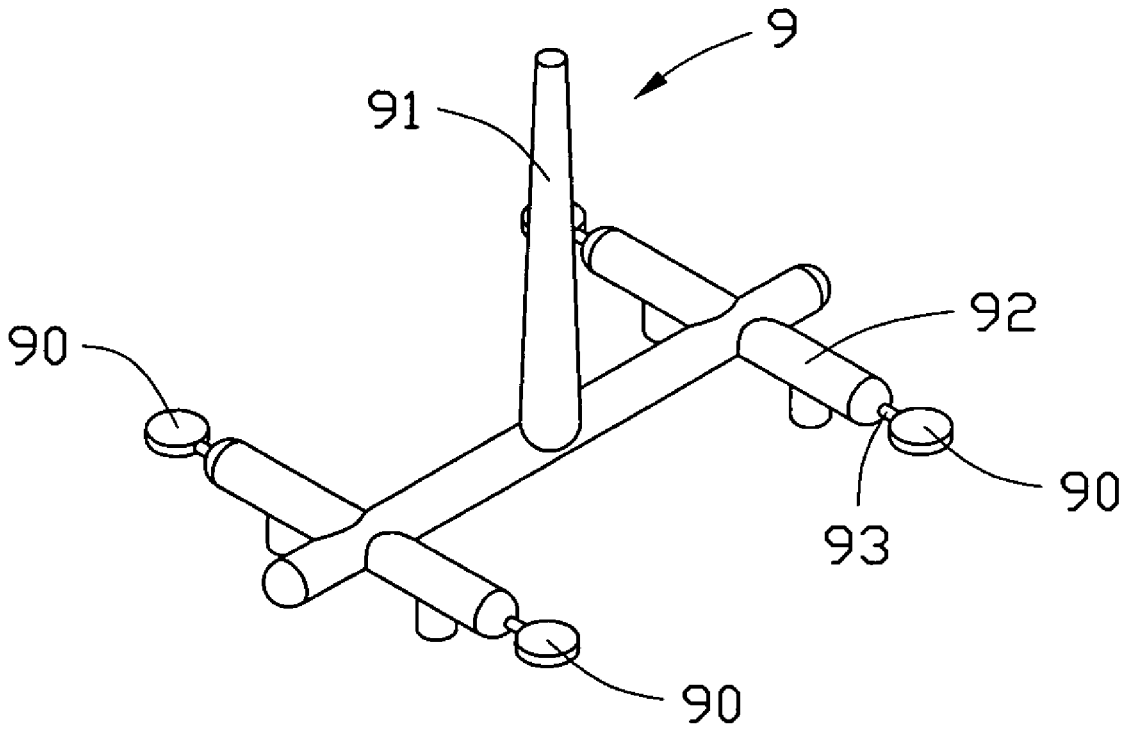
FIG. 1 is a schematic view of a semi-finished lens assembly formed by a four-cavity mold.
Figure 3A:
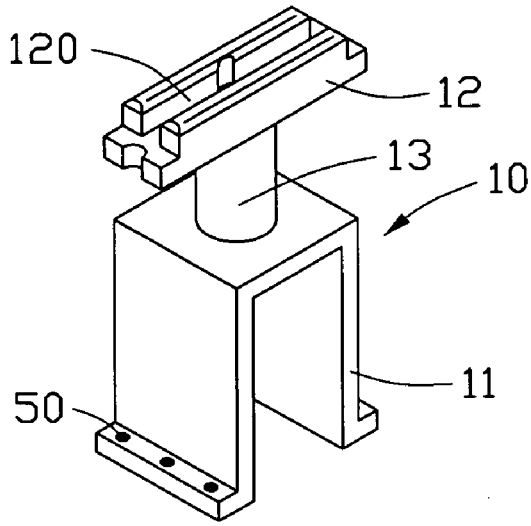
FIG. 3A is a schematic view of a carrying device of the present automatic cutting machine.
Figure 3B:
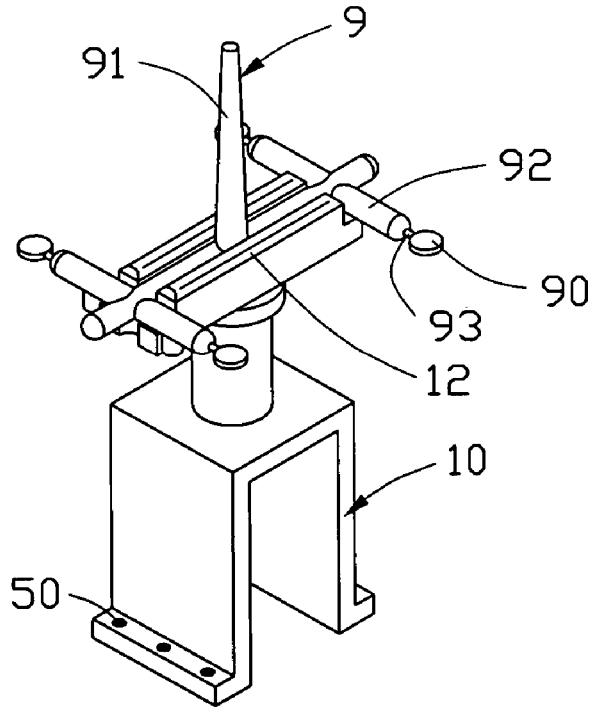
FIG. 3B is a schematic view showing the semi-finished lens assembly of FIG. 1 being received in a receptacle of the carrying device of FIG. 3A.

As shown in FIGS. 3A and 3B, the carrying device 10 comprises a shelf 11 secured to the base 40 by bolts 50, a receptacle 12 for receiving a semi-finished lens assembly 9 (FIG. 1), and a block 13 between the shelf 11 and the receptacle 12. As clearly shown in FIG. 3B, when the semi-finished lens assembly 9 is positioned in the receptacle 12, portions of the vertical runner scrap 91 and horizontal runner scrap 92 are retained in a recess 120 of the receptacle 12 with four lenses 90 at free ends of the horizontal runner scrap 92 outwardly projecting from the receptacle 12.

Figure 4:
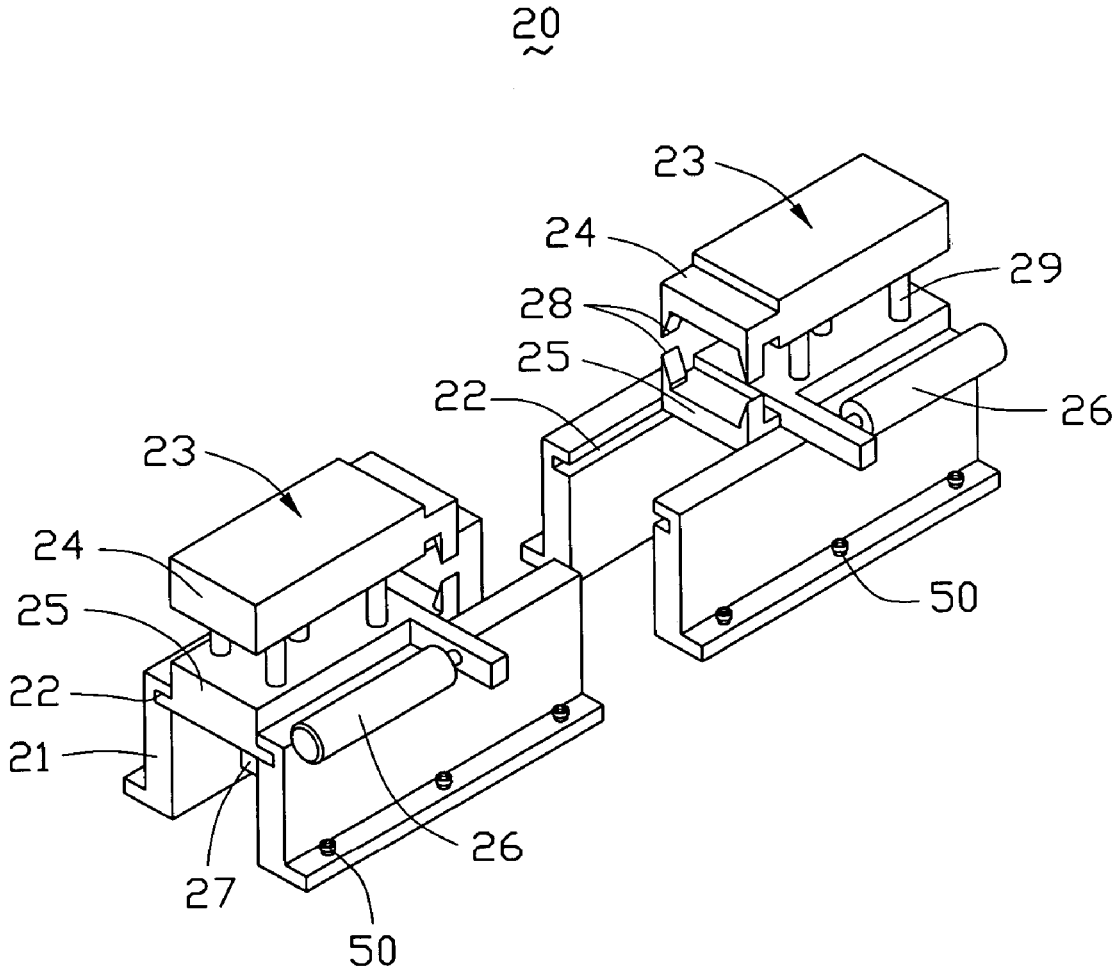
FIG. 4 is a schematic view of a cutting device of the present automatic cutting machine.

Referring to FIG. 4, the cutting device 20 includes two similar subassemblies located on opposite sides of the carrying device 10. Each subassembly of the cutting device 20 includes a shelf 21 secured to the base 40 by bolts 50, horizontal guide rails 22 defined in the shelf 21, and a scissor seat 23 horizontally movable along the guide rails 22. The scissor seat 23 has a pair of upper scissors 24 and a pair of lower scissors 25. Each of the upper and lower scissors 24, 25 has two cutting blades 28. Accordingly, four groups of vertically aligned opposing cutting blades 28 are provided on the cutting device 20 for cutting four lenses 90 at one time. Each subassembly of the cutting device 20 further comprises a first air cylinder 26 located on one side of the scissor seat 23 and a second air cylinder 27 located below the lower scissors 25. The first air cylinder 26 acts as a horizontal impeller, and the second air cylinder 27 acts as a vertical impeller. The scissor seat 23 moves backwards or forwards along the guide rails 22 when compelled by the first air cylinder 26. The opposing cutting blades 28 of the upper and lower scissors 24, 25 move toward or away from each other when compelled by the second air cylinder 27. The connecting portion 93 of the semi-finished lens assembly 9 is cut off when the opposing cutting blades 28 close. Due to the provision of four groups of opposing cutting blades 28, four lenses 90 can be cut off by the cutting device 20 at one time, thereby increasing cutting efficiency. Further, a plurality of guide posts 29 is disposed between the upper and lower scissors 24, 25 for facilitating relative vertical movement between the upper and lower scissors 24, 25. The cutting device 20 is preferably an electrothermal cutting device including a heating rod and a temperature controller. It should be understood that, the air cylinders 26, 27, which serve as the power device for the cutting device 20, may be substituted by an electromagnet or other equivalents.

Figure 5:
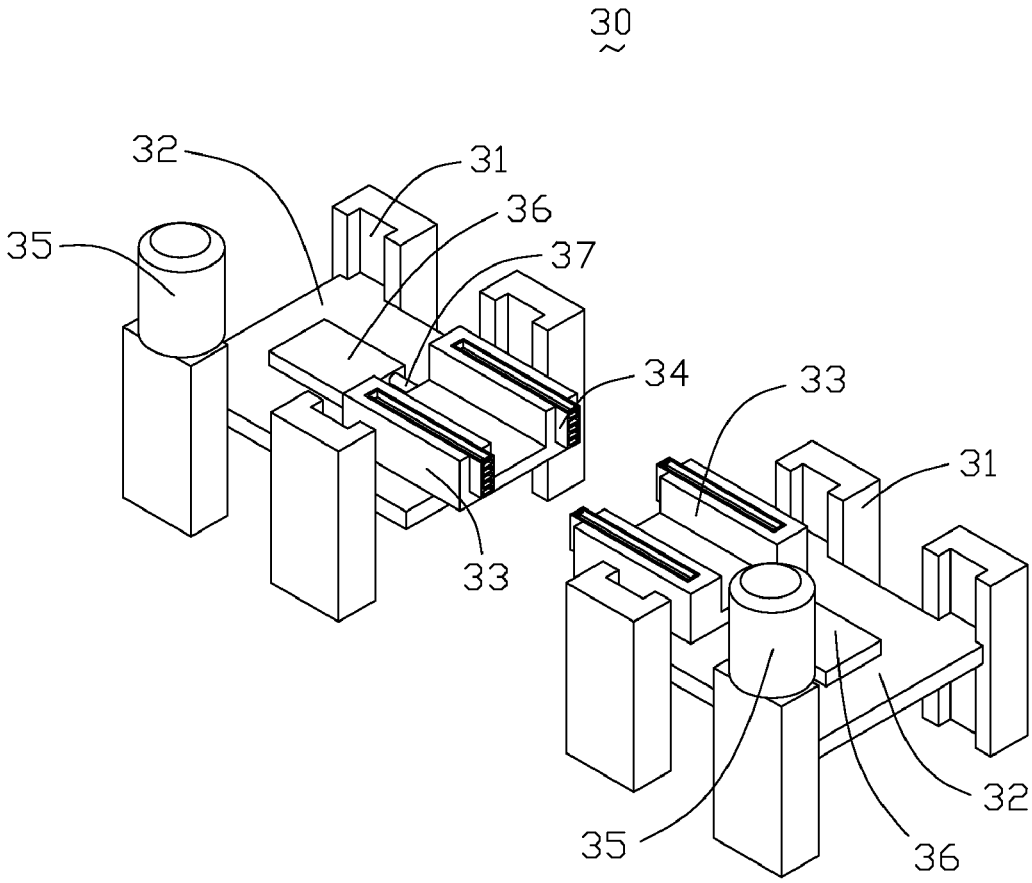
FIG. 5 is a schematic view of a take out device of the present automatic cutting machine.

As shown in FIG. 5, the take out device 30 includes two similar subassemblies located on the other opposite sides of the carrying device 10. Each subassembly of the take out device 30 includes vertical guide rails 31 acting as a shelf, a first positioning portion 32 vertically movable along the vertical guide rails 31, a second positioning portion 33 horizontally movable along an upper surface of the first positioning portion 32, and two lens receiving devices 34 provided in the second positioning portion 33. Each lens receiving device 34 includes a plurality of rows of tubular rings, each row having a plurality of rings for receiving lenses. The first positioning portion 32 is vertically movable when driven by a servo motor 35, the second positioning portion 33 is movable back and forth when driven by a third air cylinder 36, and the lens receiving device 34 is horizontally movable with the second positioning portion 33.

Figure 6:
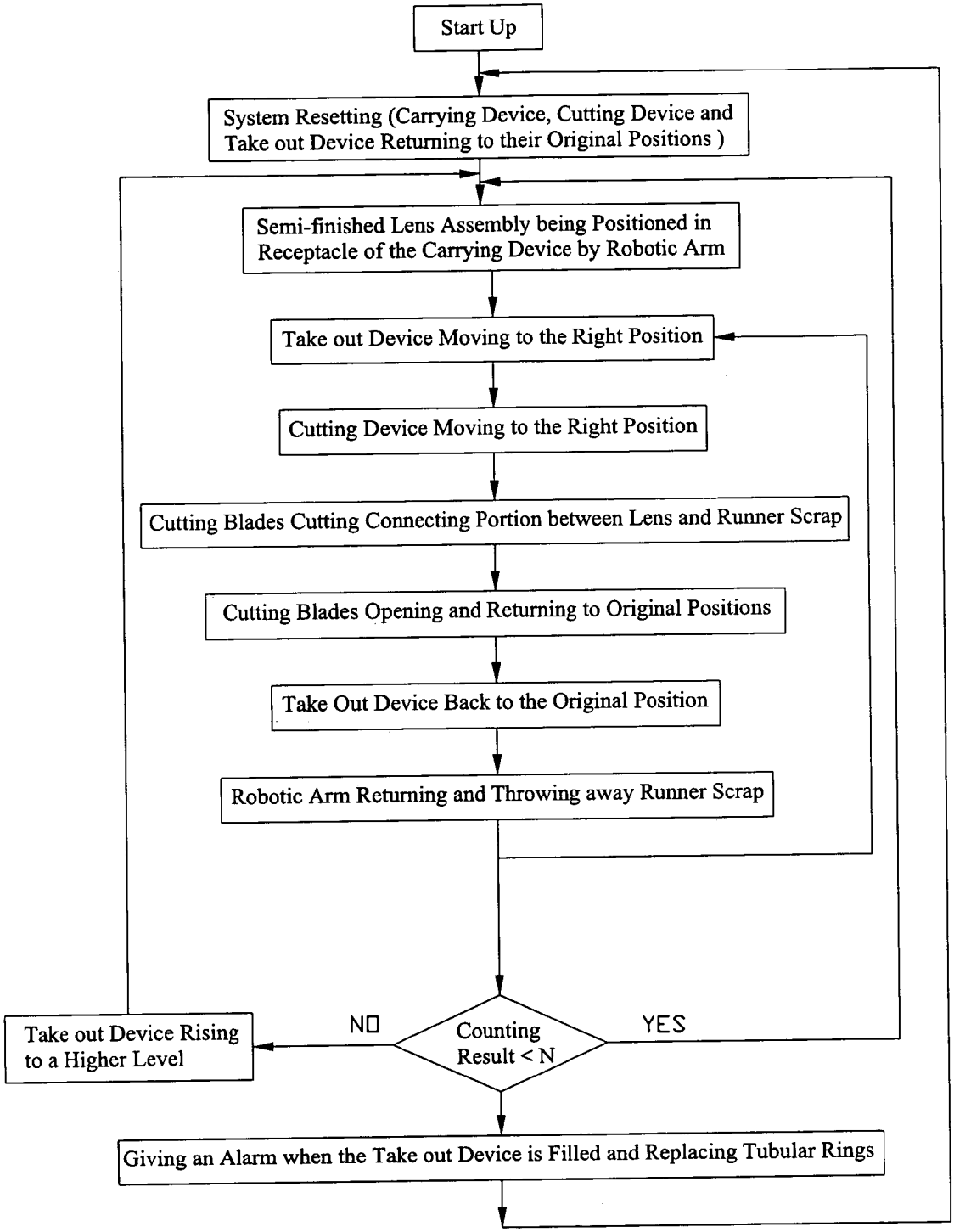
FIG. 6 is a flow chart illustrating the cutting process of the present automatic cutting machine.
Figure 7:
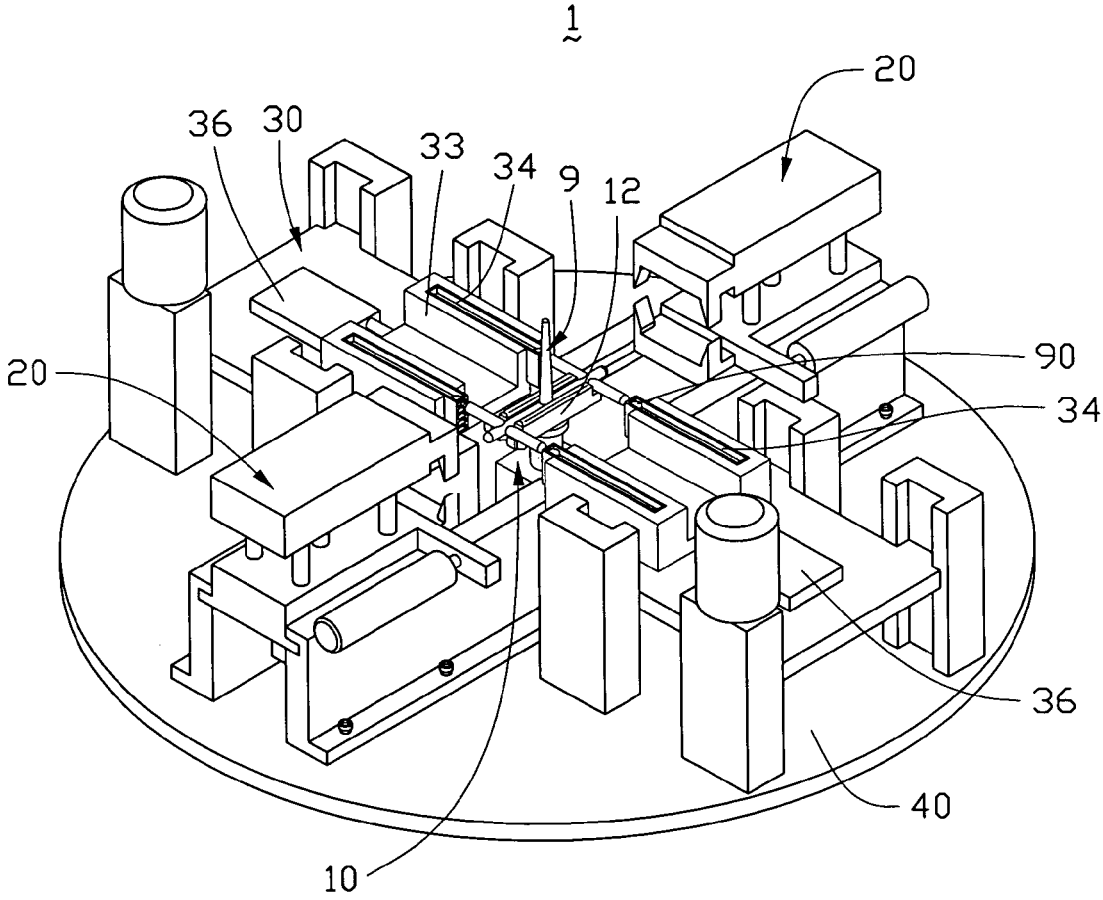
FIG. 7 is a schematic view showing the semi-finished lens assembly is positioned in the carrying device by a robotic arm, and receiving devices of the take out device receive the lenses of the semi-finished lens assembly therein.
Figure 8:
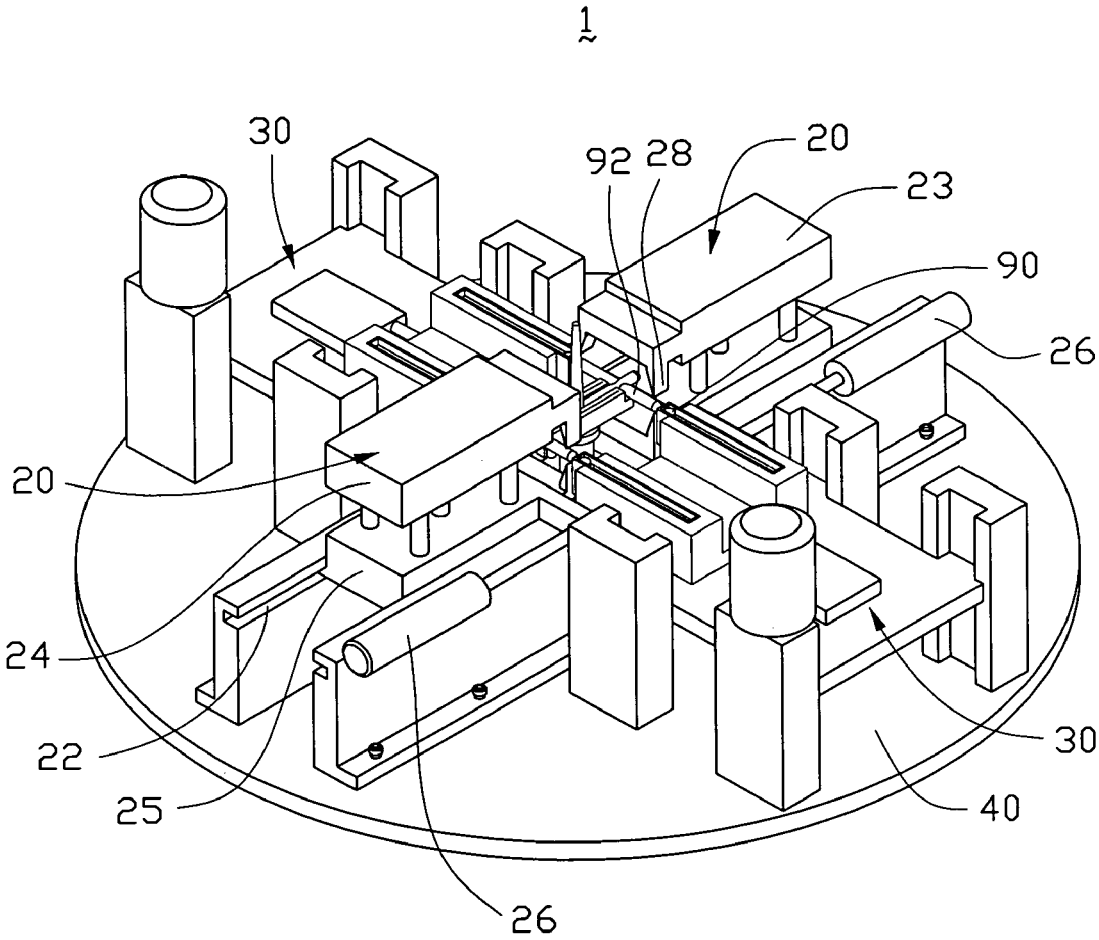
FIG. 8 is a schematic view sequential to FIG. 7, showing scissors of the cutting device move to a position vertically aligned with corresponding connecting portions of the semi-finished lens assembly between the lenses and runner scraps.
Figure 9:
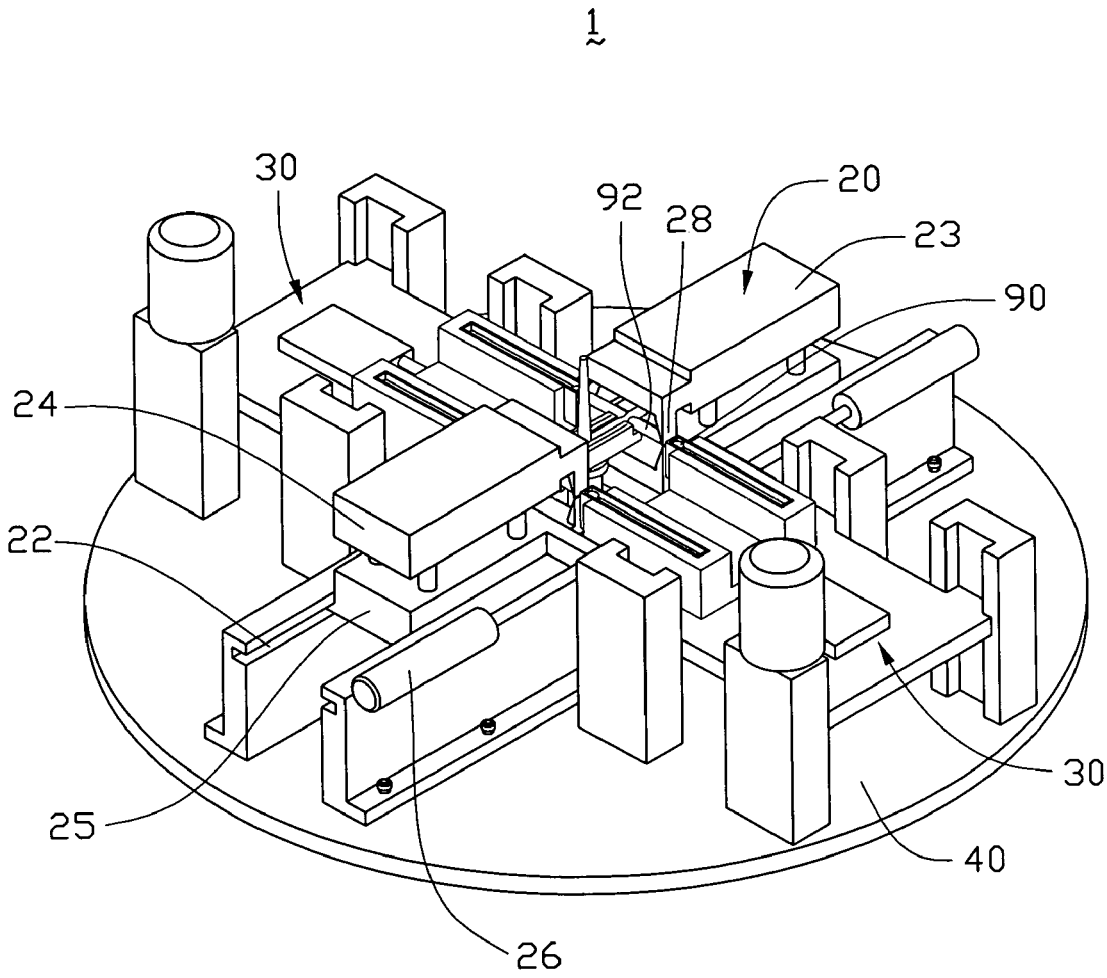
FIG. 9 is a schematic view showing the scissors of the cutting device are cutting the connecting portions of the semi-finished lens assembly to separate the lenses.
Figure 10:
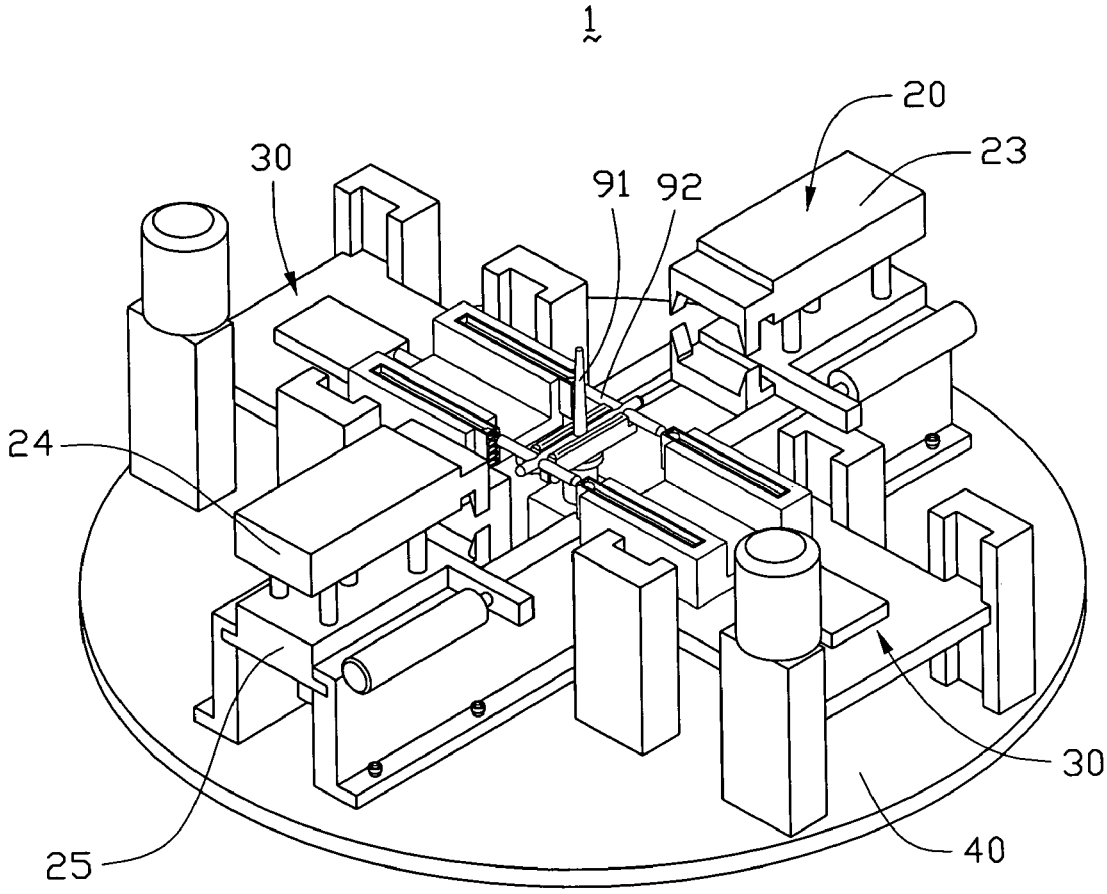
FIG. 10 is a schematic view sequential to FIG. 9, showing the scissors of the cutting device are open and return to their original positions.
Figure 11:
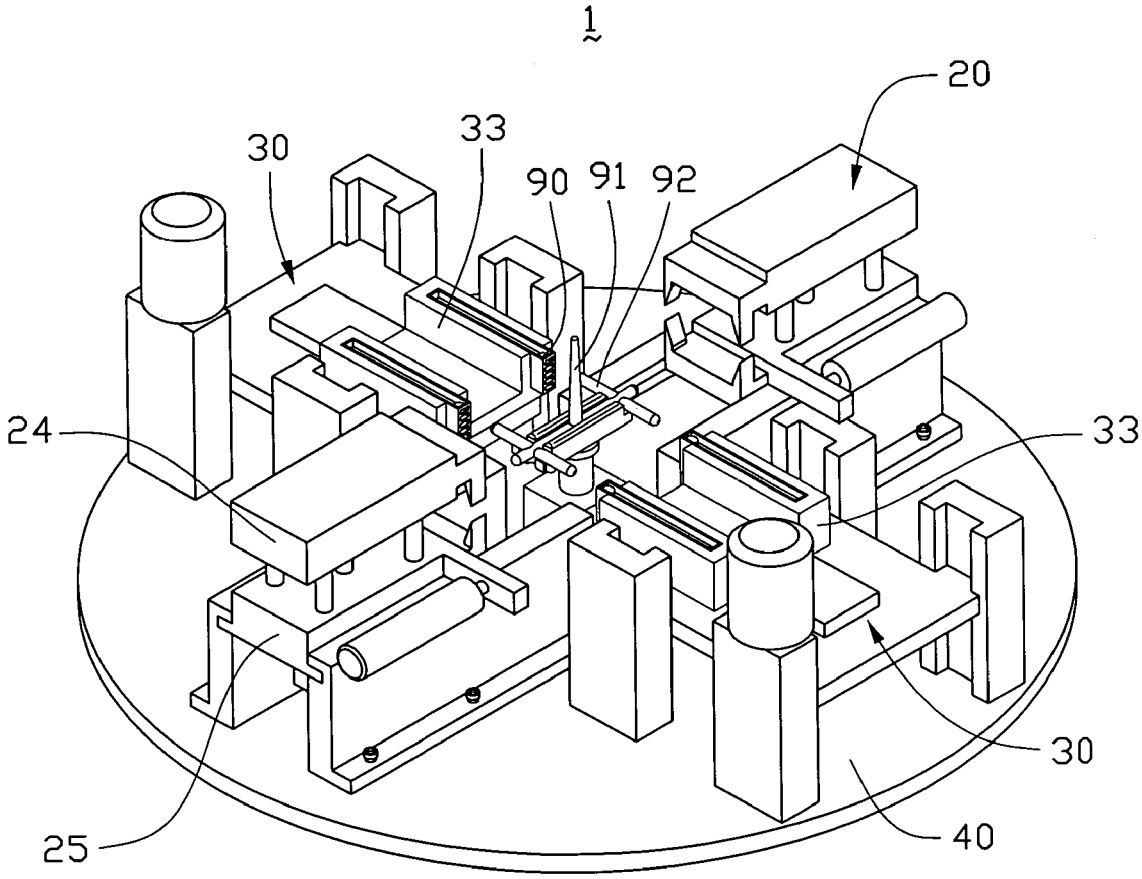
FIG. 11 is a schematic view sequential to FIG. 10, showing the receiving devices of the take out device retain the separated lenses therein and return to their original positions.
Figure 12:
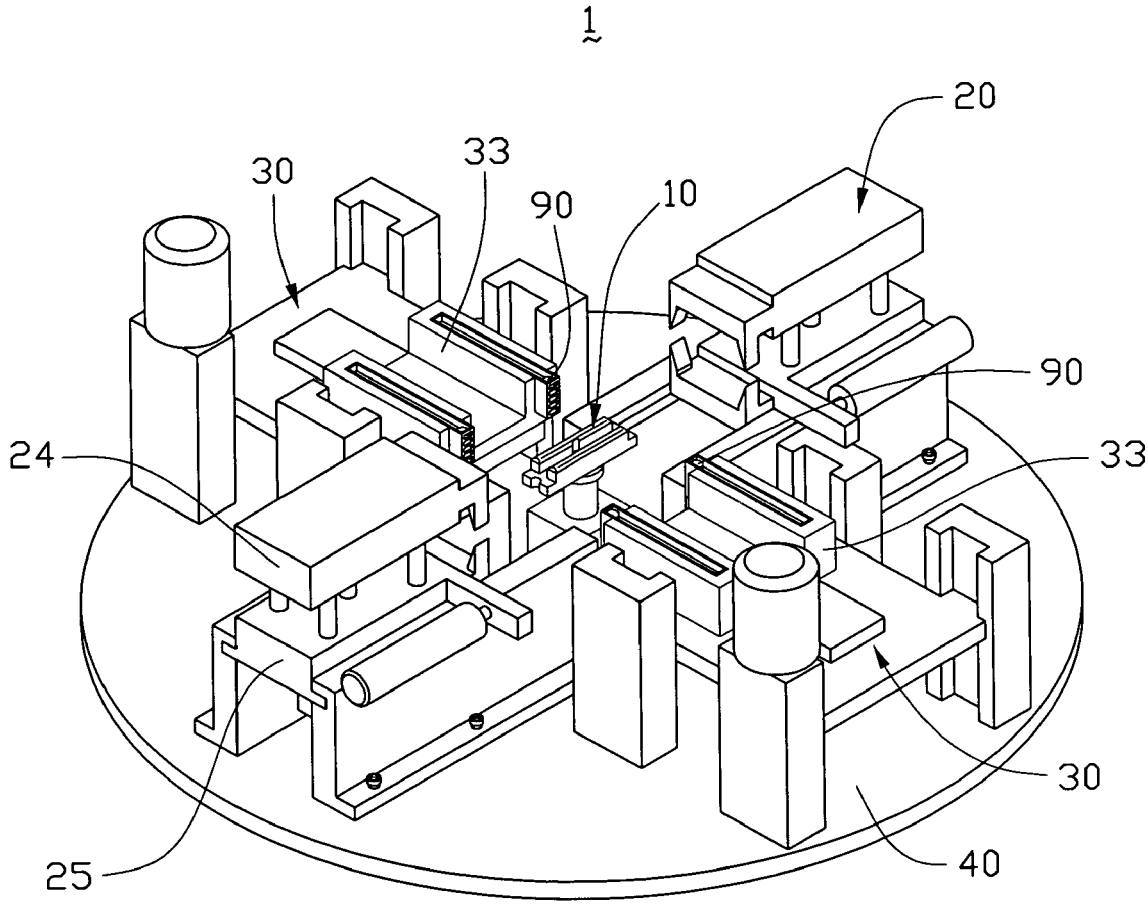
FIG. 12 is a schematic view showing the runner scraps of the semi-finished lens assembly are moved by the robotic arm.

FIG. 6 is a flow chart illustrating the cutting process of the present automatic cutting machine 1. Firstly, the gas source supply valve is opened and the power is turned on to start up the automatic cutting machine 1, and the system reset button is pressed to return the carrying device 10, the cutting device 20 and the take out device 30 to their original positions. When the devices are all resetted and the cutting blades 28 on the scissor seats 23 are heated to a predetermined temperature, detection devices of the automatic cutting machine 1 will generate corresponding ready signals. As is clearly shown in FIG. 7, after the semi-finished lens assembly 9 is positioned on the receptacle 12 of the carrying device 10 by a robotic arm (not shown), the push rod 37 of each third air cylinder 36 is extended and thus actuates the second positioning portion 33 to move inwardly to receive two lenses 90 of the semi-finished lens assembly 9 in the two respective tubular rings of the lens receiving device 34. Referring to FIG. 8, the first air cylinder 26 then actuates the scissor seat 23 to move along the guide rails 22 to a predetermined position where each group of the opposing cutting blades 28 is vertically aligned with a corresponding connecting portion 93 of the semi-finished lens assembly 9. The two opposing cutting blades 28 in the same group is then closed by actuation of the second air cylinder 27 to cut the corresponding connecting portion 93 of the semi-finished lens assembly 9, which is shown in FIG. 9. As sequentially shown in FIGS. 10-12, after the cutting operation is performed, the upper and lower scissors 24, 25 move away from each other and return to their original positions. The second positioning portion 33 for the tubular rings also returns to its original position. The robotic arm then picks up the remaining runner scraps 91, 92 of the semi-finished lens assembly 9 and throws them away en route. A counter then counts the number of the separated lenses retained in the tubular rings, and determines whether the result is less than the maximal number N of lenses capable of being received in one row of the rings.

Figure 13:
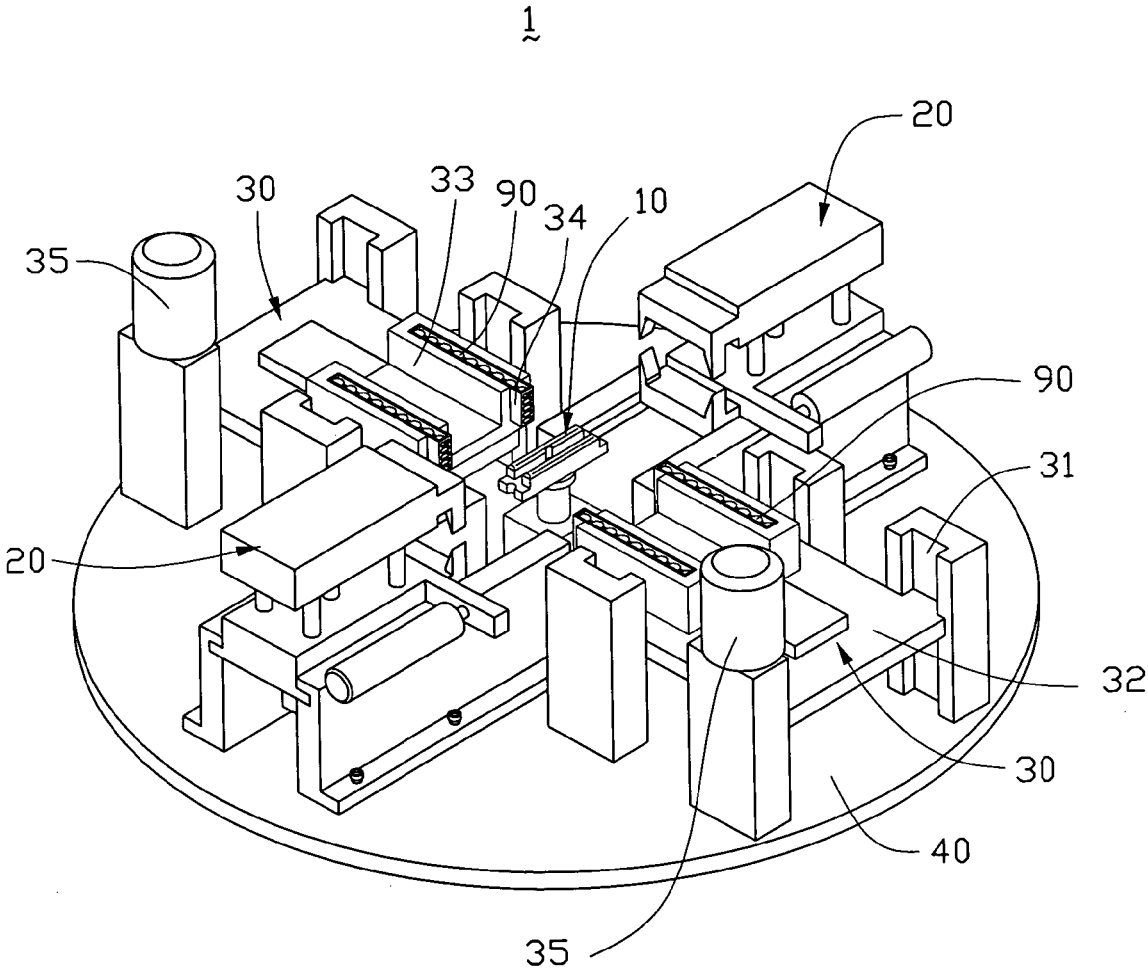
FIG. 13 is a schematic view showing one row of rings of the receiving device of the take out device is filled with lenses.
Figure 14:
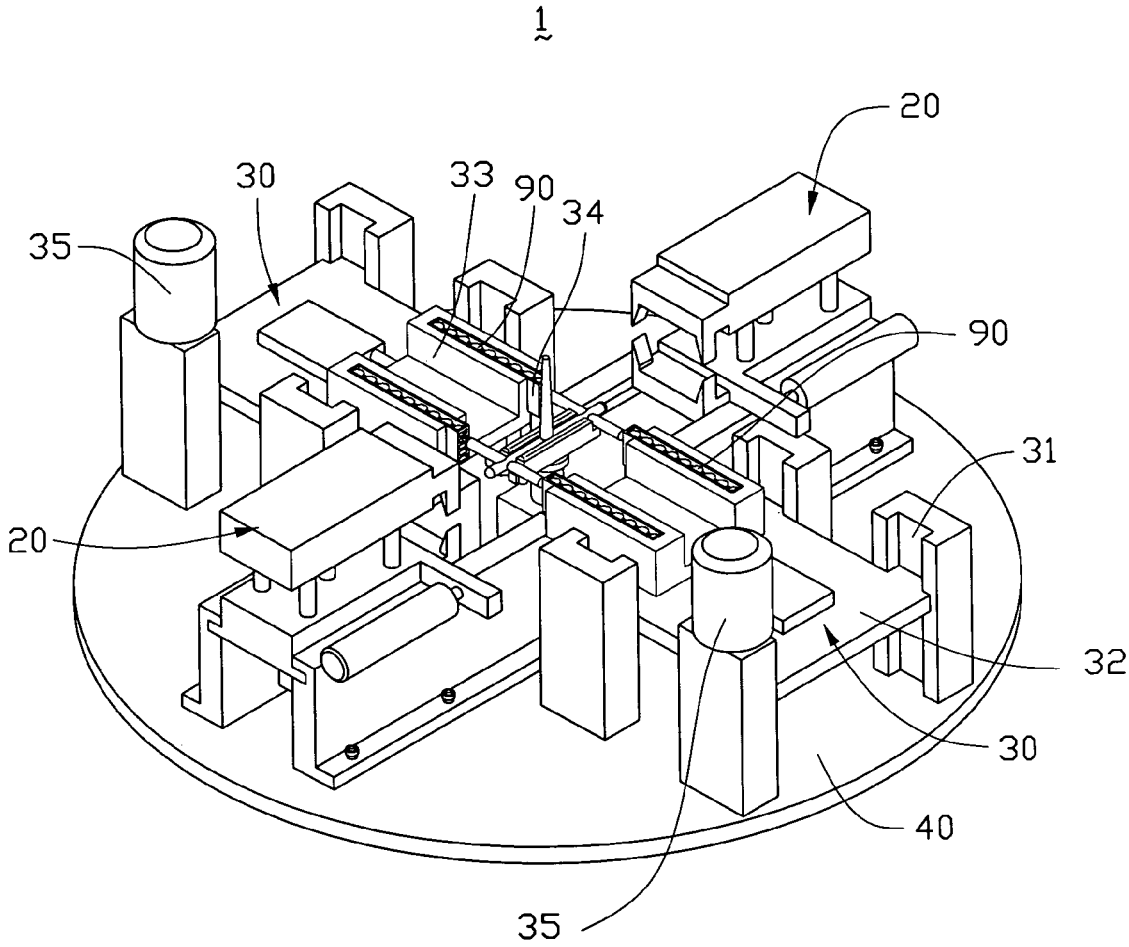
FIG. 14 is a schematic view sequential to FIG. 13, showing positioning portions of the take out device rise to a higher level so that a lower row of rings is in position for receiving lenses.
Figure 15:
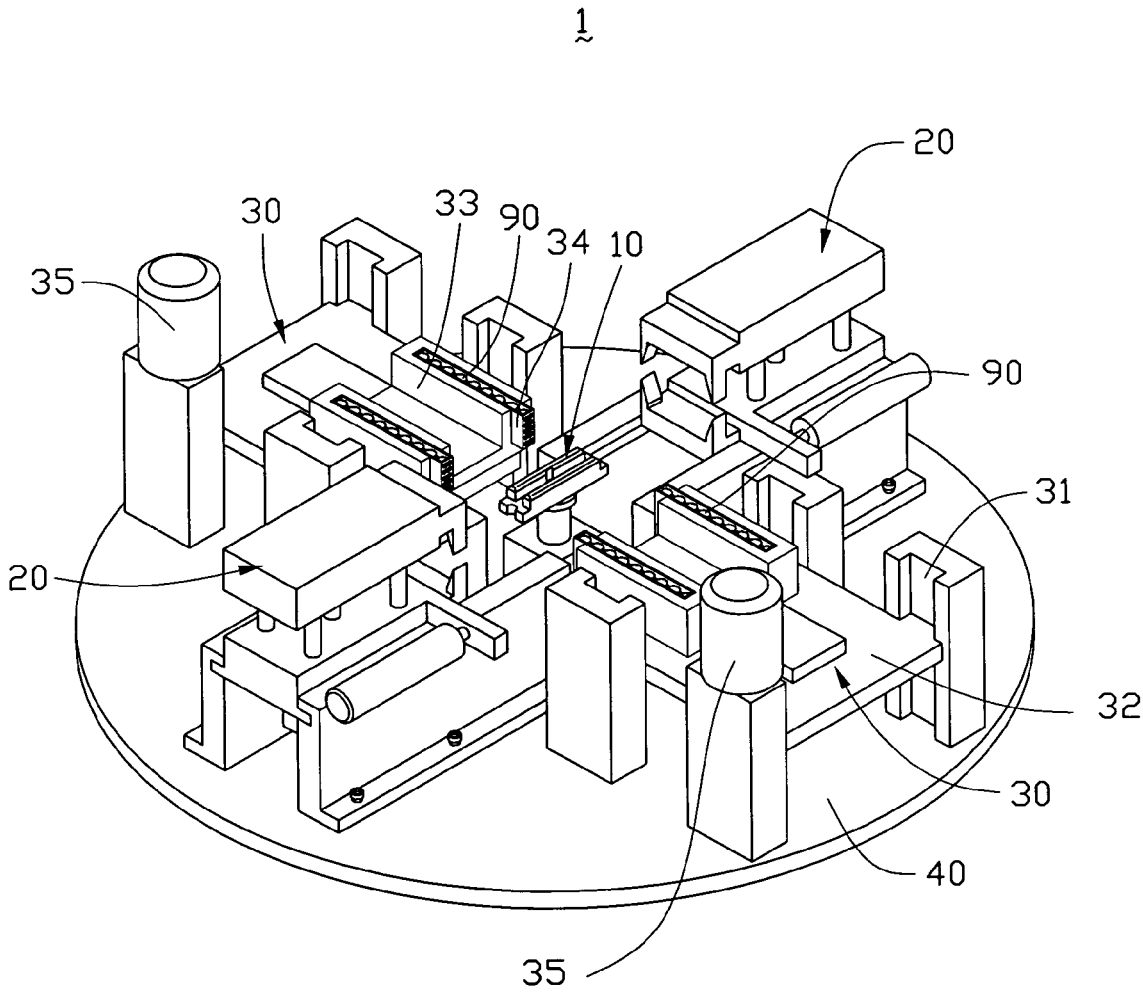
FIG. 15 is a schematic view showing all rows of rings of the receiving devices of the take out device are filled with lenses.

If the determining result of the counter is less than N, then the above-mentioned processes are recycled. As shown in FIGS. 13 and 14, if the determining result of the counter is greater than or equal to N, then the servo motor 35 of the take out device 30 actuates the first positioning portion 32 to vertically move along the guide rails 31 to a higher level, whereby a lower row of rings is raised to the right position for sequential lens receiving. As shown in FIG. 15, when the counted lens number is equal to the total number of lenses capable of being received in all rows of tubular rings, an alarm will be given by the automatic cutting machine 1 for replacement of the tubular rings or the lens receiving devices 34. After the tubular rings have been replaced, the system will be resetted to recycle the entire above-mentioned cutting processes.

During the above lens cutting processes, it can be found that the four lenses 90 of the semi-finished lens assembly 9 are cut by the cutting devices 20 at one time, and all separated lenses 90 are neatly and closely received in corresponding lens receiving devices 34. Thus, integration of lens cutting and packaging is realized, whereby the lens cutting cycle is shortened and production efficiency is increased. Further, during the cutting and take out processes, the lenses 90 are prevented from direct contact with external mechanical parts such as a robotic arm, thereby avoiding damages to the lenses 90. In addition, the operation of the present automatic cutting machine 1 is controlled by a predetermined program, and thus the present automatic cutting machine 1 is easy to operate and only a small space is occupied.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An automatic cutting machine for cutting a semi-finished element to obtain a finished element, comprising:

a body portion having a base;

a carrying device comprising a shelf mounted on the base of the body portion and a receptacle on the shelf, the receptacle being adapted for receiving the semi-finished element with a portion of the semi-finished element outwardly projecting therefrom for cutting;

a cutting device disposed adjacent to the carrying device, the cutting device comprising a shelf mounted on the base of the body portion and a scissor seat movable relative to the shelf, the scissor seat having vertically opposing cutting blades disposed thereon for cooperatively cutting the semi-finished element, the scissor seat having a pair of upper scissors and a pair of lower scissors vertically movable relative to each other when driven by a power device, the cutting blades being provided on the upper and lower scissors;

a take out device disposed adjacent to the carrying device, the take out device comprising a shelf mounted on the base of the body portion and a receiving device connected to the shelf, the receiving device being movable relative to the shelf for receiving the projected portion of the semi-finished element therein, the receiving device retaining the projected portion therein after the projected portion is cut from the semi-finished element by the cutting device; and a power device providing power to the cutting device and the take out device.

2. The automatic cutting machine as claimed in claim 1, wherein the shelf of the take out device is in the form of vertical guide rails, and the take out device further comprises a positioning member where the receiving device is disposed.

3. The automatic cutting machine as claimed in claim 2, wherein the positioning member of the take out device includes a first positioning portion vertically movable along the guide rails and a second positioning portion horizontally movable along the first positioning portion when driven by the power device, and the receiving device of the take out device is disposed on the second positioning device.

4. The automatic cutting machine as claimed in claim 1, wherein the shelf of the cutting device defines opposite guide rails therein, and the scissor seat is horizontally movable along the guide rails when driven by the power device.

5. The automatic cutting machine as claimed in claim 1, wherein the cutting device is disposed on opposite sides of the carrying device, and each pair of upper and lower scissors of the cutting device has two cutting blades, thereby providing four groups of vertically aligned opposing cutting blades.

6. The automatic cutting machine as claimed in claim 5, wherein the take out device is disposed on the other opposite sides of the carrying device and has two receiving devices, thereby providing four receiving devices about the carrying device.

7. The automatic cutting machine as claimed in claim 6, wherein the carrying device further comprises a block between the shelf and the receptacle.

8. The automatic cutting machine as claimed in claim 7, wherein the power device comprises a plurality of air cylinders.

* * * * *